US005151885A

United States Patent [19]

Kasuo

[11] Patent Number: 5,151,885

[45] Date of Patent: Sep. 29, 1992

[54] STOPWATCH

[75] Inventor: Tomoo Kasuo, Hamura, Japan

[73] Assignee: Casio Computer Co., Ltd., Tokyo, Japan

[21] Appl. No.: 858,342

[22] Filed: Mar. 26, 1992

[30] Foreign Application Priority Data

Mar. 29, 1991 [JP] Japan ..... 3-66845

[51] Int. Cl.[5] ..... G04F 8/00; G04F 10/00

[52] U.S. Cl. ..... 368/110; 368/113

[58] Field of Search ..... 368/107-113

[56] References Cited

U.S. PATENT DOCUMENTS

| | | | |
|---|---|---|---|
| 3,691,757 | 9/1972 | Merino et al. | 368/101 |
| 4,211,066 | 7/1980 | Kusumoto et al. | 368/110 |
| 4,523,857 | 6/1985 | Ushikoshi | 368/113 |
| 4,545,686 | 10/1985 | Ushikoshi | 368/113 |
| 4,831,605 | 5/1989 | Suga | 368/113 |

*Primary Examiner*—Vit W. Miska

*Attorney, Agent, or Firm*—Frishauf, Holtz, Goodman & Woodward

[57] ABSTRACT

A stopwatch according to the present invention can measure a lap time by the operation of a lap switch of a key input portion and stores the measured lap time in a RAM. When the lap switch is operated, a minute hand is immediately moved to a position of 0 o'clock, and is started its rotation from the position of 0 o'clock. The hand is rotated at such speed that the hand arrives at a position of 10 o'clock after the preceding lap time stored in the RAM is elapsed. In order to rotate the hand at the above described speed, a microprocessor unit calculates the time interval to supply pulse signal to a step motor. Since the hand is moved from the position of 0 o'clock to the position of 10 o'clock at the above described speed, percentage of the lap time being measured at present with respect to the preceding lap time can be immediately known.

18 Claims, 11 Drawing Sheets

| | |
|---|---|
| M | BT |
| ATP | BTP |
| ANP | BNP |
| Y | BL |
| LPA | S |
| ST | FR |
| FAS | N |
| FAZ | W |
| I | J |
| $MA_1$ ~ $MA_{20}$ | K |
| | $MB_{20}$ |

FIG.2

STOPWATCH

BACKGROUND OF THE INVENTION

1. Field of the Invention

The present invention relates to a stopwatch for measuring a lapse time and, more particularly, to a stopwatch for measuring a lap time by a switching operation and for displaying information regarding the measured lap time.

2. Description of the Related Art

A stopwatch, which informs an operator that a measured time arrives at a preset target time or displays a time difference between the target time and the measured time, has been widely known. For example, a stopwatch of this type is disclosed in U.S. Pat. No. 4,831,605. The stopwatch of this type is used in the field of motor sport.

In a motor car race in which motor cars run in a circuit many times, it is desired to know whether the speed of an aimed motor car raises or lowers at every one lap or not, or to know the raised or lowered degree of a measured lap time when it is compared to a target time. In a conventional stopwatch in which a target time can be set, it is remarkably troublesome to know the above described data. In the conventional stopwatch, at first an operator expects a target time in which an aimed motor car runs in a racing course for one time, and then sets the target time, for example, three minutes. After that, the difference between the measured lap time and the target time is calculated to know whether the speed of the aimed motor car raises or lowers at one lap, and then the raised or lowered degree of the measured lap time to the target time at one lap is calculated on the basis of the above described time difference. If the preceding lap time is, for example, +10 seconds with respect to the three minutes and the present lap time is, for example, +2 seconds to the three minutes, the present lap time is shorter than the preceding lap time by +8 seconds. If, however, the preceding lap time is not remembered, an operator can not know the time difference between the present lap time and the preceding lap time. Further, since the present lap time is displayed as "+2 seconds", there is the possibility that the operator misunderstands that the present lap time is longer than the preceding lap time by +2 seconds.

SUMMARY OF THE INVENTION

The present invention has been made in consideration of the above situation, and the object of the present invention is to provide a stopwatch which can inform a time difference between a measured time and a target time and a raised or lowered degree of the measured time to the target time without complicated calculation.

In order to achieve the above object, according to the present invention, there is provided a stopwatch comprising: time measuring means for starting to measure time on a basis of a start command; a lap switch to be operated during a time measurement by the time measuring means; lap time means for obtaining time information from the preceding operation of the lap switch when the lap switch is operated; and hand means rotatably driven to a position of "0" o'clock when the lap switch is operated, and to a position of "10" o'clock when the same time as the time information obtained by the lap time means is elapsed.

With the arrangement described above, the stopwatch of the invention can extremely readily inform speed-up or -down and its degree of an aimed motor car.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 2 shows a detailed arrangement of a RAM shown in FIG. 1;

DETAILED DESCRIPTION OF THE PREFERRED EMBODIMENTS

An embodiment of the present invention will be described below with reference to the accompanying drawings.

First Embodiment

Figure 1:
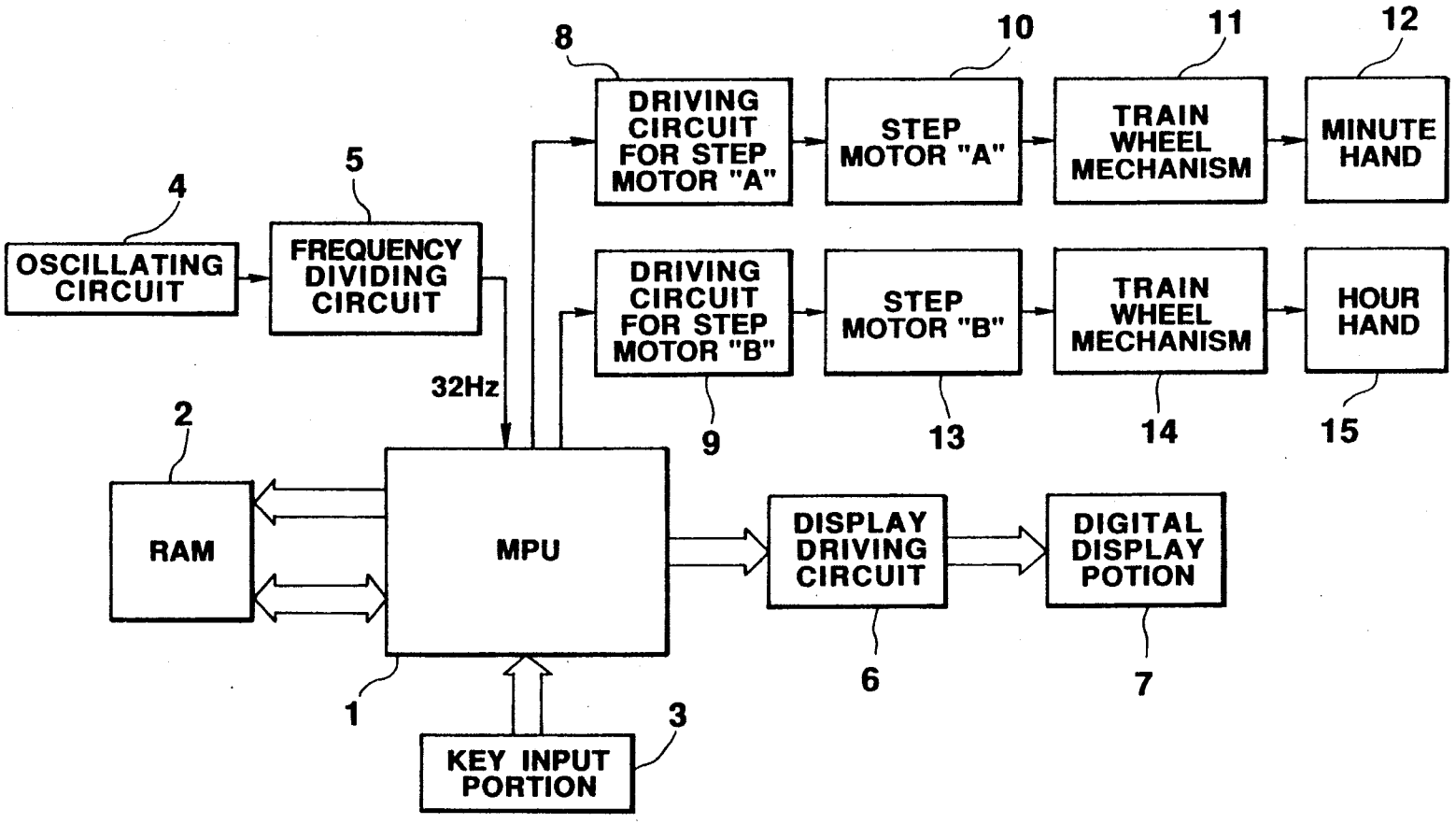
FIG. 1 is a block diagram showing an circuit arrangement of a stopwatch according to the present invention.

FIG. 1 is a block diagram of a circuit arrangement of a stopwatch of the present invention. In FIG. 1, a microprocessor (MPU) 1 includes a CPU, a ROM, an input/output port, and a clock generator, each of which are not shown. A RAM (Random Access Memory) 2 is connected to the MPU 1 through a bus line. The output of a key input portion 3 including keys SH, S1 to S5 described later is input to the MPU 1. An oscillating circuit 4 supplies an oscillation output of 32768 Hz to a frequency dividing circuit 5. The frequency dividing circuit 5 divides the frequency of the oscillation output signal to 32 Hz, and supplies it to the MPU 1. A display data is output from the MPU 1 to a display driving circuit 6, and liquid crystal segments of a digital display portion 7 is driven by the output of the display driving circuit 6.

Driving signals are further output from the MPU 1 to a driving circuit for a step motor "A" and a driving circuit for a step motor "B", respectively.

A step motor "A" 10 is driven by the output of the driving circuit 8 for the step motor "A". The rotary force of the step motor "A" 10 is transmitted to a minute hand 12 through a train wheel mechanism 11, and the minute hand 12 rotates in one cycle when the step motor "A" 10 is driven at 180 steps. A step motor "B" 13 is driven by the output of the driving circuit 9 for the step motor "B", and the rotary force of the step motor "B" 13 is transmitted to an hour hand 15 through a train wheel mechanism 14. When the step motor "B" 13 is driven at 180 steps, the hour hand 15 rotates in one cycle.

The key input portion 3 has pushbutton type keys SM, S1 to S5 described later. The key SM is a mode selection key. Whenever the key SM is operated, a time piece mode and a stopwatch mode are alternately selected. The key S1 is used to start/stop a measurement in the stopwatch mode. The key S2 is used to measure a lap time for an aimed object in the stopwatch mode. The key S3 is a function selecting key in the stopwatch mode, and the keys S4 and S5 are used to set and alter a standard lap time and an alarm display time.

FIG. 2 shows an arrangement of the RAM 2. A mode register M is used to store various modes. When "0" is stored in the mode register M, a time piece mode for displaying a present time by the minute hand 12 and the hour hand 15 is designated, while when "1" is stored, a stopwatch mode for measuring a time as a stopwatch is designated. A time storage register BT is used to store a present time data, and 1/32 second is added in synchronization with the signal of 32 Hz input from the frequency dividing circuit 5 to the MPU 1.

A minute hand present position storage register ATP is used to store the position of the minute hand 12. The minute hand 12 rotates in one cycle at 180 steps as described above, i.e., moves for a one-minute scale at three steps. In the register ATP, numeric value data of "0" to "179" in which "0" is allocated to the position of 12 o'clock is stored in accordance with the rotational angle of the minute hands 12. An hour hand present position storage register BTP is used to store the position of the hour hand 15. The hour hand 15 rotates in one cycle at 180 steps as described above. In other words, the hour hand 15 moves for a one-minute scale at three steps. In the register BTP numeric value data of "0" to "179" is which "0" is allocated to the position of 12 o'clock is stored in accordance with the rotational angle of the hour hand 15. In a minute hand moving position storage register ANP, one of the numeric values of "0" to "179" is set to move the minute hand 12 from the position of 12 o'clock by a rotational angle being proportion to the set numeral value. In an hour hand moving position storage register BNP, one of the numeric values of "0" to "179" is set to move the hour hand 15 from the position of 12 o'clock by a rotational angle being proposion to the set numeral value.

A register LPA is used to detect a timing for moving the minute hand 12 in the stopwatch mode. "1" is set in a measuring start/stop flag register FR during measuring in the stopwatch mode, and "0" is set during non-measuring. A measured time storage register ST is used to store a measured time in the stopwatch mode. "1" is set in a register FAS when the minute hand 12 arrives at the position of 12 o'clock during a simulation of the preceding lap time by the minute hand 12 in the stopwatch mode. "1" is set in a register FAZ when the key S2 is operated to measure next lap time before the minute hand 12 arrives at the position of 12 o'clock during a simulation of the preceding lap time by the minute hand 12 in the stopwatch mode, and "0" is set when the minute hand 12 is quickly moved to the position of 12 o'clock to display a next lap time by minute hand 12.

A lap number storage register I is used to store the number of measured laps of an aimed object in the stopwatch mode, i.e., is used to store the number of operations of the key S2 after the measurement is started. Lap memories $MA_1$-$MA_{20}$ are used to store measured lap times of the aimed object in the first to twentieth measured laps of the aimed object.

A register Y is used to store a lapse time from the lap time measurment start of the aimed object. A register BL is used to store data of a preset standard lap time. A register S is used to store data of alarming display continuous time which informs that the present lap time being measured at present is longer than the standard lap time or the preceding lap time. A register K is a flag register for determining whether not the alarming display is conducted or not. If "0" is set in the register K the alarm display is not executed, and if "1" is set the alarm display is executed. A register N is a flag register for selecting a standard lap time or a preceding lap time as a reference object for the present lap time being measured at present. If "0" is set in the register N, the standard lap time is selected as the reference object, and if "1" is set in the register N the preceding lap time is selected. A register J is used to select one of the register N, the register BL, the resistor S and the register K when data is set in one of the register N, the register BL, the register S and the register K. A register W is used to start calculating operation.

Figure 3:
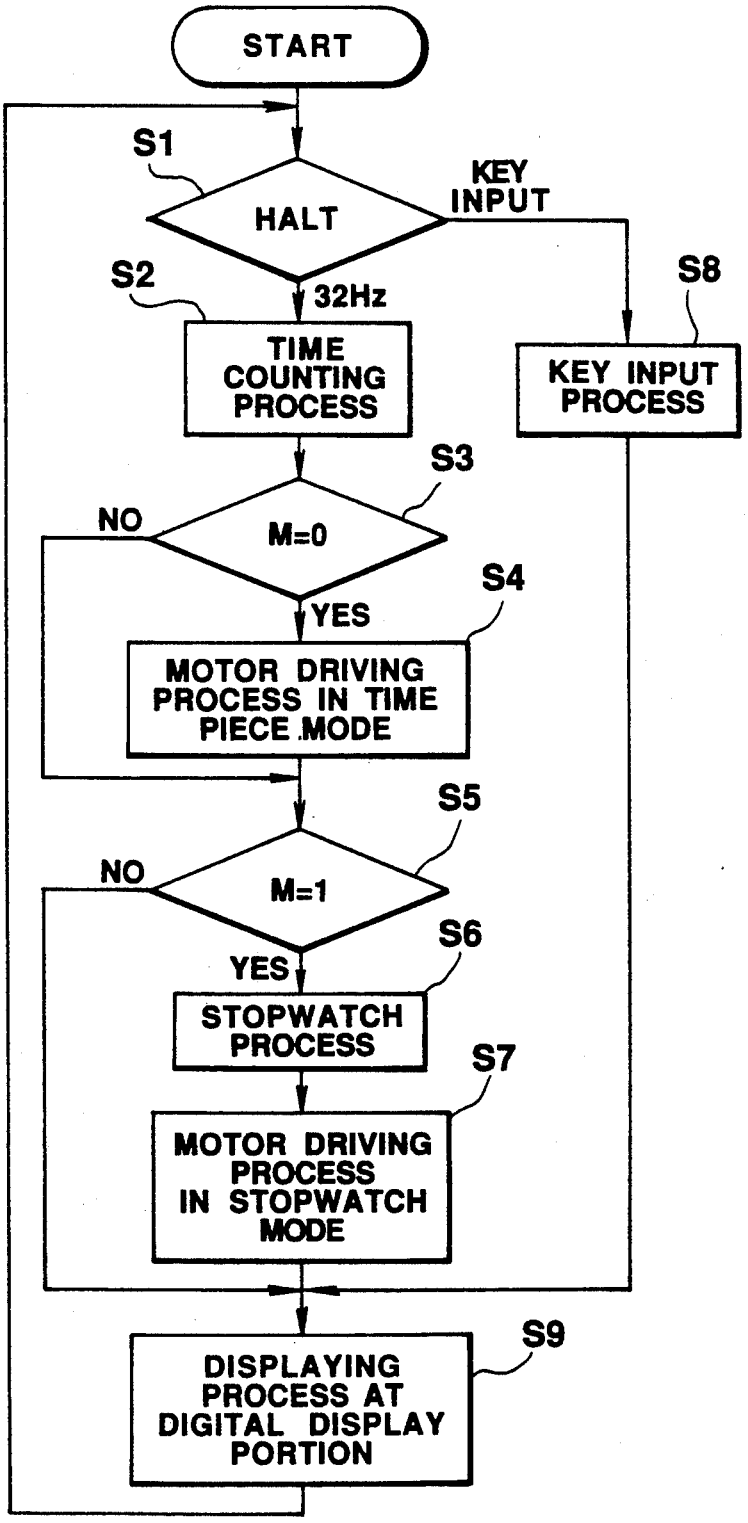
FIG. 3 is a general flow chart schematically showing the operation of the stopwatch of the present invention.

FIG. 3 is a general flow chart of the operation of the embodiment of the stopwatch of the present invention. In FIG. 3, the CPU in the MPU 1 executes a predetermined initializing routine, and then starts a program shown in the general flow chart. The CPU is always set to a waiting state in a step S1 in the routine of the flow chart. When the key input portion 3 is operated, a key input process in a step S8 and a displaying process at a digital display portion in a step S9 are executed, and the routine returns to the step S1. Whenever the signal of 32 Hz from the frequency dividing circuit 5 is input to the MPU 1, a time counting process in a step S2 is executed. In this step S2, 1/32 second is added to the time storage register BT for storing the present time to progress the present time. Then, in a step S3, it is judged whether the value in the mode register M for identifying mode (hereinafter referred merely to as "the value of the register M") is set to "0" or not, that is whether a time piece mode is set or not. When the value of the register M is set to "0", a motor driving process in the time piece mode in a step S4 is executed, and then the routine advances to a step S5.

When, in the step S3, it is judged that the value of the register M is not "0", the routine advances to the step S5. In the step S5, it is judged whether a stopwatch mode is set or not, that is whether the value of the register M is set to "1" or not. If, in the step S5, it is judged that the value of the register M is not "1", the routine is branched to a step S9, while if the value of the register M is "1", a stopwatch process in a step S6 and a motor driving process in the stopwatch mode in a step S7 are executed, and then the routine advances to the step S9. In the step S9, in the time piece mode (M="0"), the present time of the register BT is displayed on the digital display portion 7, while in the stopwatch mode (M="1"), the measured time of the measured time storage register S and alarm are displayed.

Figure 4:
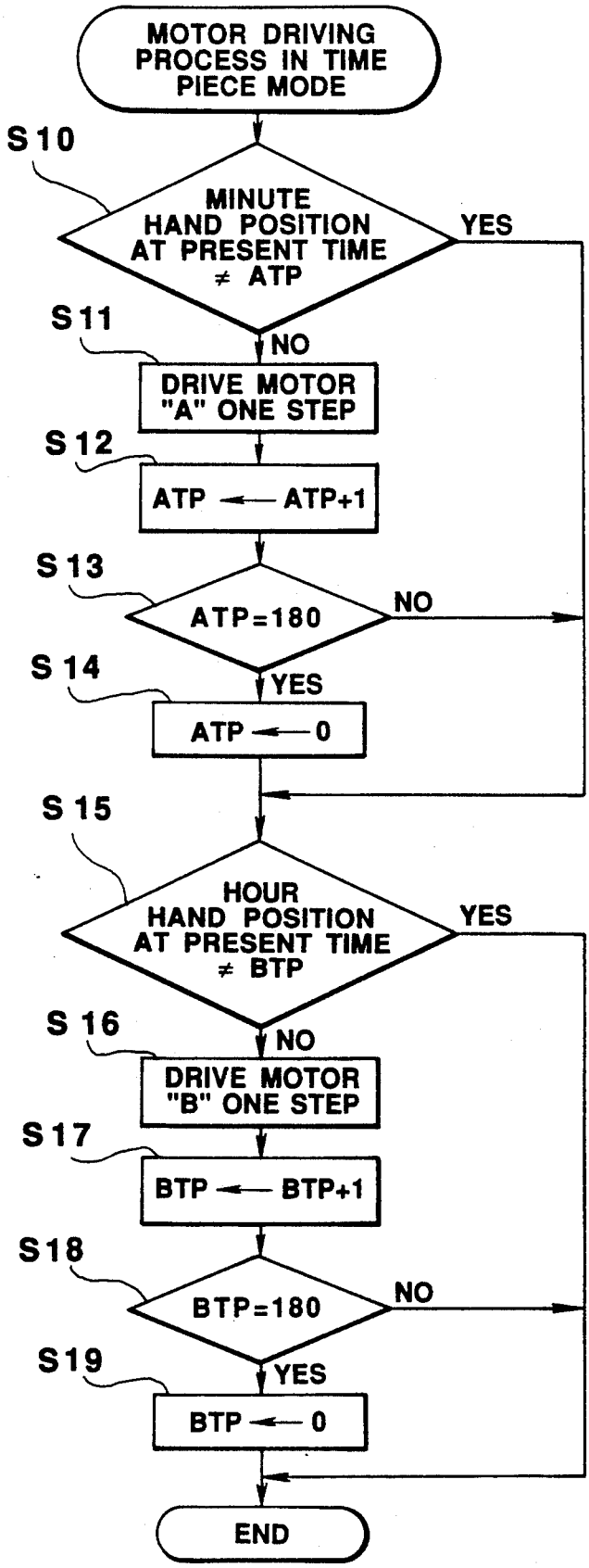
FIG. 4 is a flow chart showing the detail of a time piece mode motor driving process of a step S4 shown in FIG. 3.

FIG. 4 is a flow chart showing the detail of the motor driving process in the time piece mode in the step S4. In this process, at first in a step S10 it is judged whether the minute hand position of the present time coincides with the content of the minute hand present position storage register ATP or not. If both coincide with each other, the routine of this flow chart advances to a step S15, while if both do not coincide with each other, a step S11 is executed. In the step S11 , the step motor "A" for driving the minute hand 12 is driven one step. Then, in a step S12, "1" is added to the content of the register ATP. The minute hand 12 and the hour hand 15 are rotated in one cycle at 180 steps (0 to 179). In a step S13, it is checked whether the content of the register ATP becomes 180 or not. If the content of the register ATP does not become 180, the routine advances to the step S15. If the content of the register ATP becomes 180, "0" is set to the register ATP in the step S14, and the register ATP is returned to its initial state.

In the step S15, it is judged whether the hour hand position of the present time coincides with the content of the hour hand present position storage register BTP or not. If both coincide with each other, the routine of this flow chart of the step S4 is completed. If both do not coincide with each other, a step S16 is executed similarly to the control of the minute hand 12 in the step S11 to drive the step motor "B" for moving the hour hand 15 one step. Then, the routine advances to a step S17, and "1" is added to the content of the register BTP. Thereafter, in a step S18, it is judged whether the content of the register BTP becomes 180 or not. If the content of the register BTP does not yet become 180, the routine of this flow chart of the step S4 is completed. If the content of the register BTP becomes 180, "0" is set to the register BTP in a step S19, and then the routine of this flow chart of the step S4 is completed. The routine of FIG. 4 is executed at every 32 Hz. If the positions of the minute hand 12 and the hour hand 15 do not coincide with those for displaying the present time in the time piece mode, the minute hand 12 and the hour hand 15 are quickly moved at 32 Hz until the positions of the minute hand 12 and the hour hand 15 coincide with those for displaying the present time.

Figure 5:
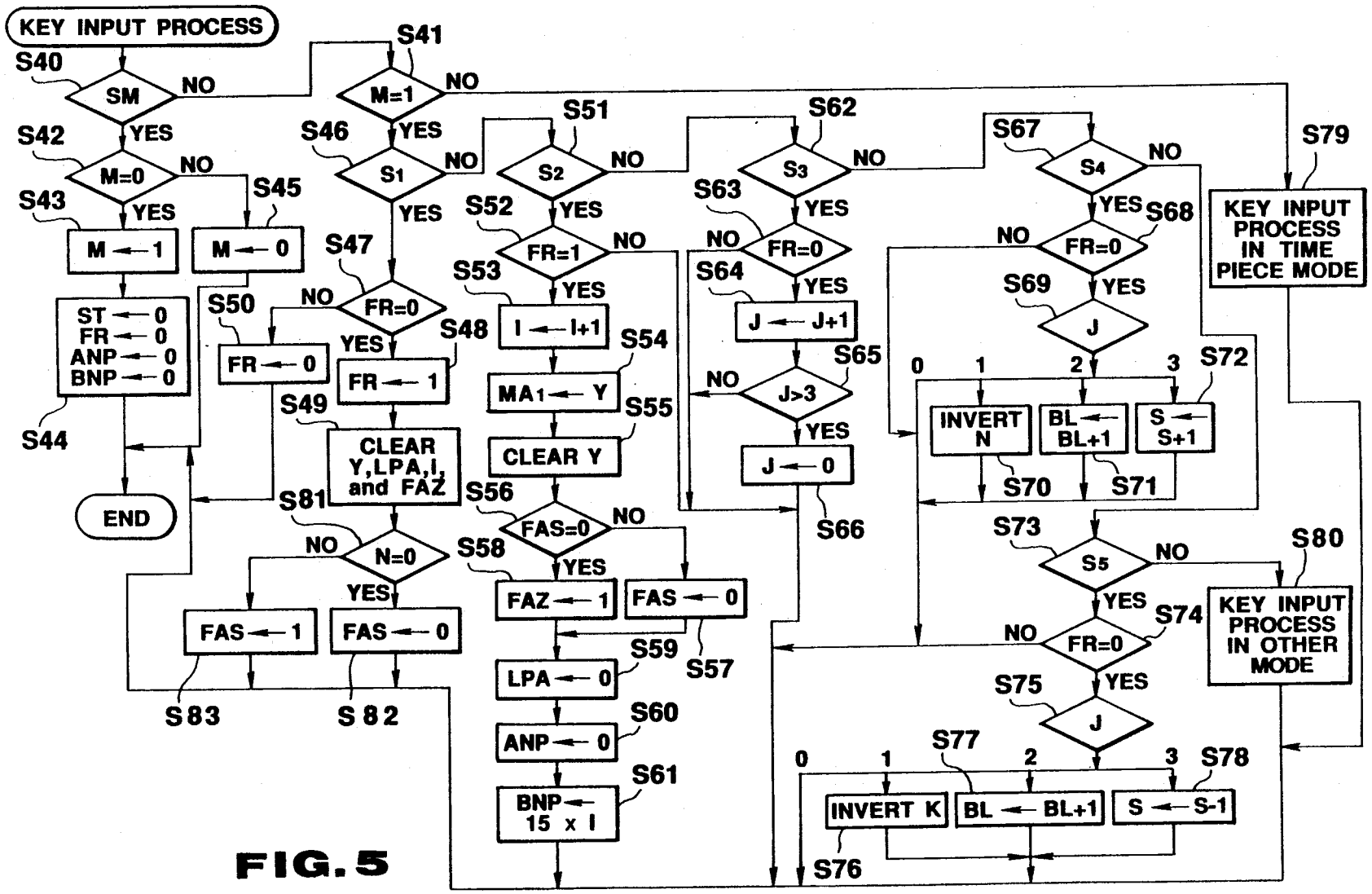
FIG. 5 is a flow chart showing the detail of a key input process of a step S8 shown in FIG. 3.

FIG. 5 is a flow chart showing the detail of the key input process in the step S8 of FIG. 3. In this key input process, whenever the mode selection key SM is operated, the time piece mode and the stopwatch mode are alternatively switched. At first, it is judged whether the key SM is operated or not in a step S40. If the key SM is not operated, the routine of this flow chart advances to a step S41, and in the step S41 it is judged whether the value of the register M is "1" or not. If the value of the register M is not "1", the time piece mode is set at present. Accordingly, the key input process for such as time setting in this mode is executed in a step S79, and this routine is completed.

When, in the step S40, it is judged that the key SM is operated, the routine advances to a step S42, and in the step S42 it is judged whether the value of the register M is "0" or not. More specifically, it is judged which one of the time piece mode and the stopwatch mode is set at present. If the value of the register M is "0", the routine advances to a step S43, and in the step S43 "1" is set to the register M. Then, a stopwatch mode initial process in a stop S44 starts, and "0" are set respectively to the stopwatch measured time storage register ST, the measuring start/stop flag register FR, the minute hand moving position storage register ANP, and the hour hand moving position storage register BNP. If the value of the register M is not "0", the routine advances to a step S45, "0" is set to the register M to set the time piece mode, and the routine of this flow chart is then completed In the step S41, when the value of the register M is "1", the key input process in the stopwatch mode is executed, and in a step S46 it is judged whether the key S1 of the key input portion 3 is operated or not. The key S1 functions as a control key for controlling the start/-stop of measurement in the stopwatch mode. When the key S1 is operated, the routine advances to a step S47, and in the step S47 it is judged whether the value of the register FR is "0" or not, i.e., whether the lap time is measuring or not. If the value of the flag register FR is "0" and the lap time is not measuring, "1" is set to the measuring start/stop flag register FR in a step S48 to start the measuring of the lap time, and then a step S49 is executed. In the step S49, "0" is set to the register Y, the register LPA, the lap number storage register I and the register FAZ, respectively, and "1" is set to the flag register FAS. If the value of the register FR is not "0" in the step S47, i.e., the lap time is measuring, the routine advances to a step S50. In the step S50 "0" is set to the register FR to stop the lap time measurement, and the routine is completed.

When the key S1 is not operated in the step S46, in a step S51 it is judged whether a key S2 in the key input portion 3 for measuring lap time of an aimed object is operated or not. When the key S2 is not operated, the routine advances to a step S62, while when the key S2 is operated, in a step S52 it is judged whether the value of the register FR is "1" or not, i.e., whether the lap time is measuring at present or not. If the key S2 is operated when the lap time is not measuring, it is an erroneous operation, and the routine is finished without any operation thereafter.

If the key S2 is operated while the lap time is being measured, the value of the lap number storage register I is incremented in a step S53. Then, in a step S54 a lapse time data from a time point when the preceding lap measurement for the aimed object is finished is stored from the register Y in the storage area (I-th storage area: I=the present lap number) of the lap number storage register $MA_I$. "0" is set in the register Y in a step S55, the content of the register FAS is checked in a step S56, and it is judged whether the minute hand arrives at a position "0" (12 o'clock) or not. If the minute hand has already arrives at the position of 12 o'clock, it means that the lap time at present is longer than the preceding lap time, and "0" is set in the register FAS in a step S57. If the minute hand has not arrives at the position of 12 o'clock, it means that the lap time at present is shorter than the preceding lap time, and "1" is set in the register FAZ in a step S58. Then, "0" is set in the register LPA in a step S59, and "0" is set in the register ANP in a step S60. In order to calculate the number of steps for displaying time positions by considering that one cycle of the rotation of the minute hand is 180 steps, the value of the register I is multiplied by 15 times, and the result therefrom is set in the register BNP in a step S61.

In a step S62, it is judged whether a function selection key S3 is operated or not in the stopwatch mode. When the function selection key S3 is not operated, the routine advances to a step S67, while when the function selection key S3 is operated, the value of the register FR is checked in a step S63 to judged whether the lap time is now being measured or not. When the key S3 is operated even during the lap time is not being measured, it is judged that the operation is erroneous, and the routine is finished without any operation thereafter. If the key S3 is operated during the lap time is being measured, "1" is added to the data of the function selection identification register J in a step S64. Then, in a step S65 it is judged whether the value of the data of the register J is not larger than the maximum value "3" or not, the maximum value being the maximum number of function being able to be executed. If the value of the data of the register J is not larger than "3", the routine of this flow chart finishes. If the value of the data of the register J is larger than "3", "0" is set in the register J in a step S66 to make the value of the register J return to its initial value.

If, in the step S62, it is judged that the function selection key S3 is not operated, the routine advances to a step S67 to judged whether a key S4 is operated or not. If the key S4 is not operated, the routine is advanced to a step S73, while if the key S4 is operated, in a step S68 it is judged whether the value of the register FR is "0" or not. When the value of the register FR is not "0", it means that the lap time is not being measured at present. Thus, it is judged that the operation is erroneous, and the routine of this flow chart finishes without any operation thereafter. When the value of the register FR is "0", in a step S69 it is judged which one of "0", "1", "2" and "3" is the value of the register J. When the value of the register J is "0", the routine of the flow chart is finished without any operation thereafter, while when the value of the register J is "1", the present state "1" or "0" of the data of the register N is inverted in a step S70 to designate to display which one of a standard lap time of the alarm display and the preceding lap time, and the routine of the flow chart is finished. If the value of the register J is "2", the value of the register BL is incremented in a step S71, i.e., "+1" is added to the data of the standard lap time, and the routine of the flow chart is then finished. If the value of the register J is "3", the value of the register S is incremented in a step S72, i.e., "+1" is added to the data of the alarm display continuous time, and the routine of the flow chart is finished.

If, in the step S67, it is judged that the key S4 is not operated, the routine advances to a step S73 to judge whether a key S5 is operated or not. If the key S5 is not operated, the routine advances to a step S80, while if the key S5 is operated, in a step S74 it is judged whether the value of the register FR is "0" or not. When the value of the register FR is not "0", it means that the key S5 is operated even not during the lap time is being measured. Thus, the operation is erroneous, and the routine of this flow chart is finished without any operation thereafter. When the value of the register FR is "0", in a step S75 it is judged which one of "0", "1", "2", and "3" is the value of the register J. When the value of the register J is "0", the routine of the flow chart is finished without any operation thereafter. When the value of the register J is "1", the present state "1" or "0" of the data of the register K is inverted in a step S76 to switch the alarm display to be executed or not, and the routine of this flow chart is finished. If the value of the register J is "2", the value of the register BL is decremented in a step S77, i.e., "−1" is added to the data of the standard lap time. When the value of the register J is "3", the value of the register S is decremented in a step S78, i.e., "−1" is added to the data of the alarm display continuous time.

Figure 6:
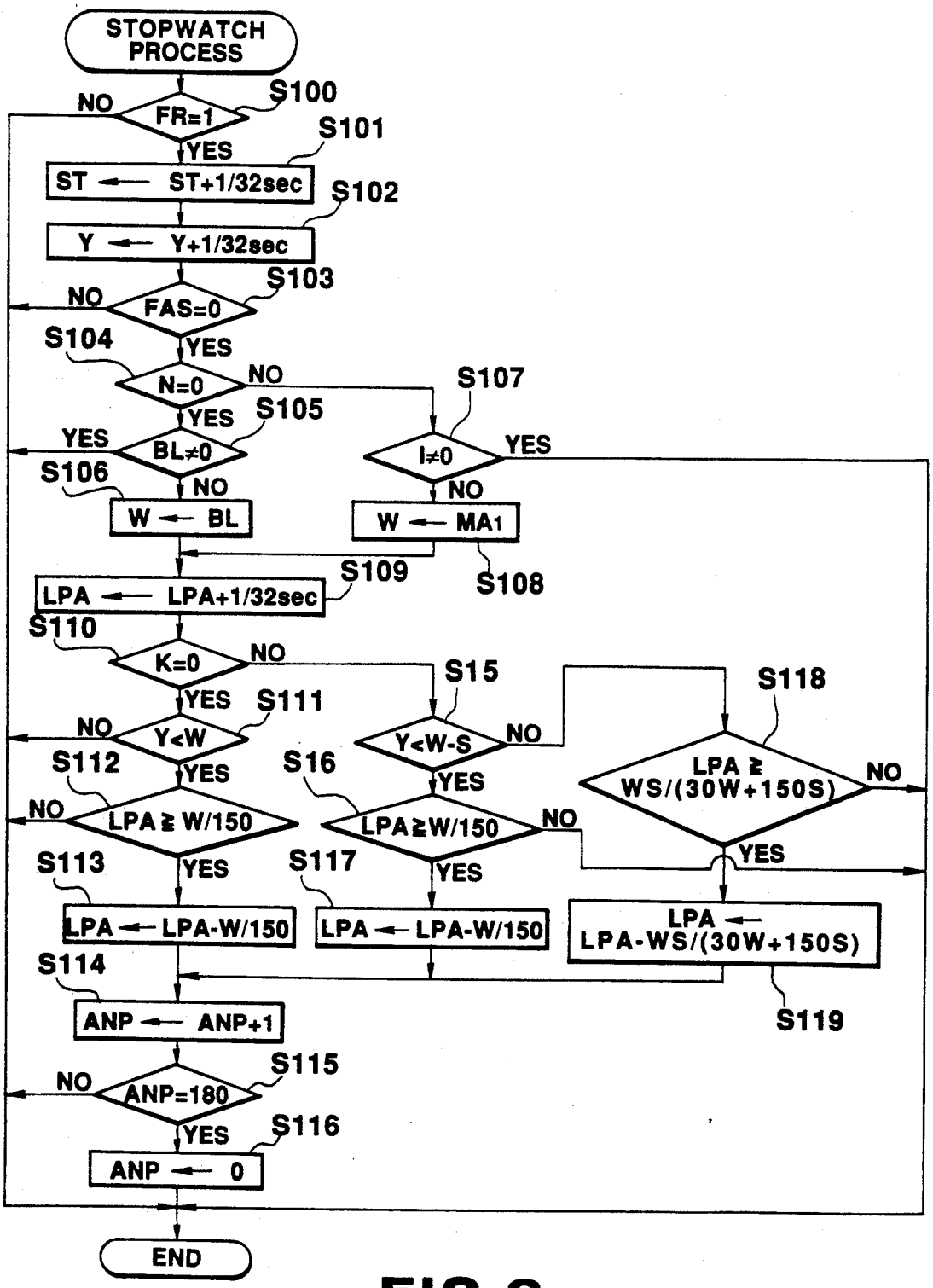
FIG. 6 is a flow chart showing the detail of a stopwatch process of a step S6 shown in FIG. 3.

FIG. 6 is a flow chart showing the detail of the stopwatch process of the step S6 in FIG. 3, and this process is executed in the stopwatch mode. In this flow, at first in a step S10 it is judged whether the content of the measuring start/stop flag register FR is "1" or not. When the content of the register FR is not "1", it means that the lap time is not being measured. Thus, the routine of this flow chart is finished without any operation thereafter. When the content of the register FR is "1", 1/32 second is added to the measured time storage register ST in a step S101, and the routine advances to a step S102. In the step S102, 1/32 second is added to the register Y to renew the lapse time from a point of time at which the meaning of the preceding lap time of an aimed object is finished, and in a step S103 it is judged whether the content of the register FAS is "0" or not. In other words, it is checked whether the minute hand is positioned at a position of 12 o'clock. When the content of the register FAS is not "0", i.e., when the minute hand is positioned at the position of 12 o'clock, the routine of this flow chart is finished. If the value of the register FAS is "0", in a step S104 it is judged whether the value of the data of the register N is "0" or not to check which one of the standard lap time and the preceding lap time is selected as an object to be compared therewith. When the standard lap time is selected as the object to be compared, in a step S105 it is judged whether the data of the standard lap time is set in the register BL or not. When it is not set, the routine of this flow chart is finished. If the data of the standard lap time is set in the register BL, the data of the register BL is transferred to a work register W in a step S106, and the routine of this flow chart advances to a step S109. If it is judged that the preceding lap time is selected as the object to be compared in the step S104, in a step S107 it is judged whether the lap time have ever be measured at least one time or not. If the lap time have not ever be measured, the routine of this flow chart is finished without any operation when the lap time is measured at the first time. If the lap time have ever be measured at least one time, the preceding lap time data is read from the lap storage memory MAI, and written in the work register W, and then the routine of the flow chart advances to a step S109.

In the step S109, 1/32 second is added to the data of the register LPA to renew the data. Then, in a step S110, the value of the register K is checked, to judge whether the alarm display is needed or not. If the value of the register K is "0", the alarm display is not executed, and only a process for executing "%" display is executed, and in a step S111 it is judged whether the measured time for this lap in the register Y is smaller than one of the standard lap time or the preceding lap time in the register W. If the value of the register Y is not smaller than the value of the register W, the routine of this flow chart is finished. When the value of the register Y is smaller than the value of the register W, in a step S112 it is judged whether the value of the register Y is larger than or equal to the period of one step (i.e., 1/150 (W/150) of the value of the data of the register W) when the minute hand 12 is moved from the position of 0 o'clock to the position of 10 o'clock for the preceding lap time. If the value of the register Y is smaller than 1/150 of the value of the data of the register W, the routine of this flow chart is finished. If it is not satisfied with this condition, 1/150 of the value of the data of the register W is subtracted from the value of the data of the register LPA in a step S113, and the routine of this flow chart advances to a step S114.

In a case the alarm display is executed in the step S110, the routine of this flow chart branches to a step S115 to judge whether the measured time for this lap in the register Y is shorter than the value obtained by subtracting the alarm display continuous time from the value of the data of the register W or not. If it is shorter than the value, the routine of this flow chart advances to a step S116. If it is longer than the value, the routine advances to a step S118. In the step S116 and the step S117 subsequent thereto, the same process as those executed in the steps S112 and S113 are executed, and the routine advances to the step S114. In the step S118, it is judged whether the value of the data of the register LPA is equal to or larger than the quotient obtained by dividing the product, resulting from multiplying the value of the register W by the alarm display continuous time data, by the sum of the 30 times of the value of the register W and the 150 times of the alarm display continuous time data. If it is smaller than the quotient, the routine of this flow chart is finished. If it is equal to or larger than the quotient, the quotient is subtracted from the data of the register LPA in a step S119, and the routine advances to the step S114.

In the step S114, "1" is added to the value of the minute hand moving position storage register ANP. Then, in the step S115, it is judged whether the value of the minute hand moving position storage register ANP is 180 or not. If the value of the register ANP is not 180, the routine of this flow chart is finished. When the value of the register ANP is 180, "0" is set in the register ANP in the step S116 to return the register ANP to its initial state. Then, the routine of this flow chart is ended.

Figure 7:
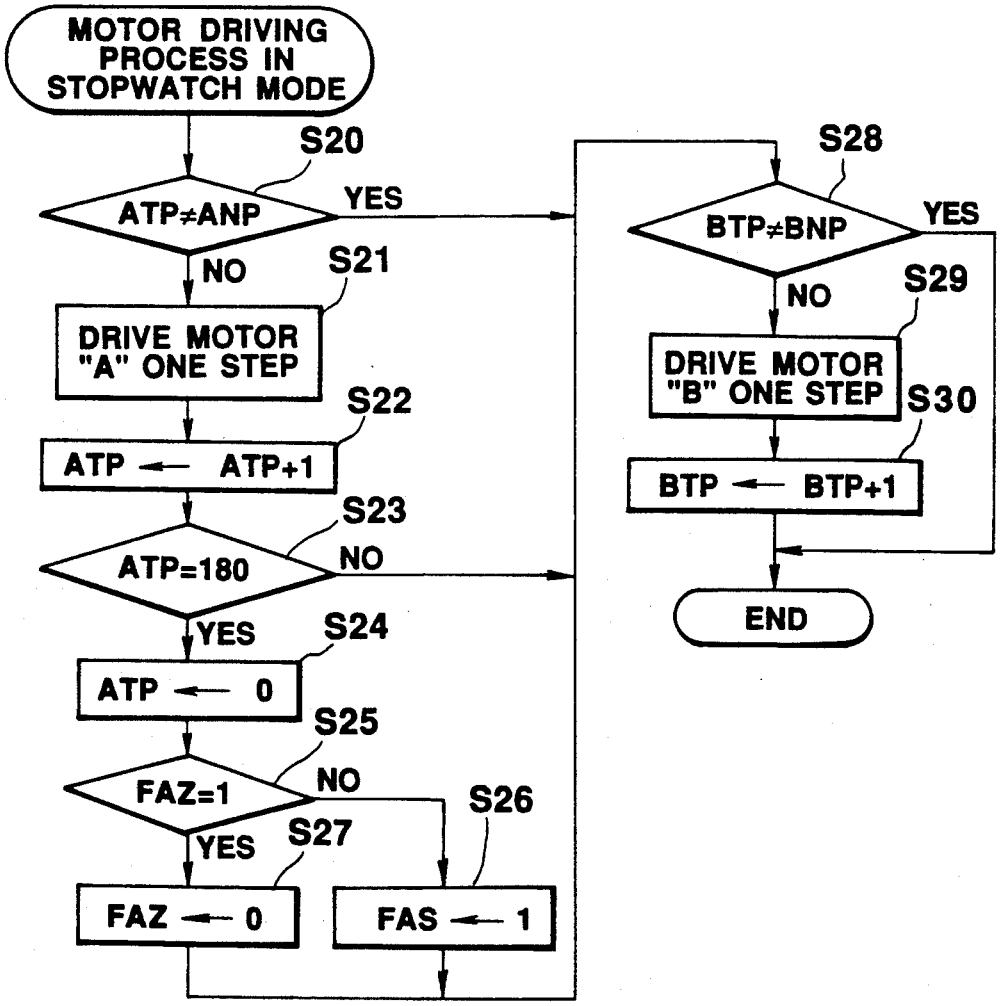
FIG. 7 is a flow chart showing the detail of a stopwatch mode motor driving process of a step S7 shown in FIG. 3.

FIG. 7 is a flow chart showing the detail of a stopwatch motor driving process of the step S7 of FIG. 3. In a step S20, it is judged whether the content of the minute hand moving position storage register ANP coincides with that of the minute hand present position storage register ATP or not. When both coincide with each other, the routine of the flow chart is branched to a step S28. When both do not coincide which each other, the routine advances to a step S21, the step motor "A" for driving the minute hand is driven one step. Subsequently, in a step S22, the content of the register ATP is incremented. Then, the routine advances to a step S23, and in the step S23 it is judged whether the numeric value of the data of the register ATP is 180 or not. In other words, it is judged whether the minute hand is positioned at a position of 12 o'clock or not. If it is not 180, the routine advances to the step S28, while it is 180, the content of the register ATP is set at "0" in the step S24, and the routine advances to a step S25. In the step S25, it is judged whether the content of the flag register FAZ is "1" or not, the flag register FAZ being used for judging whether the key S2 is operated to end the measurement of a lap time before the minute hand 12 is positioned at the position of 12 o'clock or not. When the content of the register FAZ is not "1", the routine advances to a step S26, and "1" is set to the flag register FAS for judging whether the minute hand arrives at the position of 12 o'clock within the preceding lap time of the aimed object or not. Then, the routine advances to a step S28. When the content of the register FAZ is "1", "0" is written in the register FAZ in a step S27.

In the step S28, it is judged whether the content of the hour hand moving position storage register BNP coincides with that of the hour hand present position storage register BTP or not. When both coincide with each other, the routine of this flow chart is ended. When both do not coincide with each other, the routine advances to a step S29 to drive the step motor "B" for driving the hour hand. Subsequently, in a step S30, the content of the register ATP is incremented, and then the routine is ended.

Figure 8:
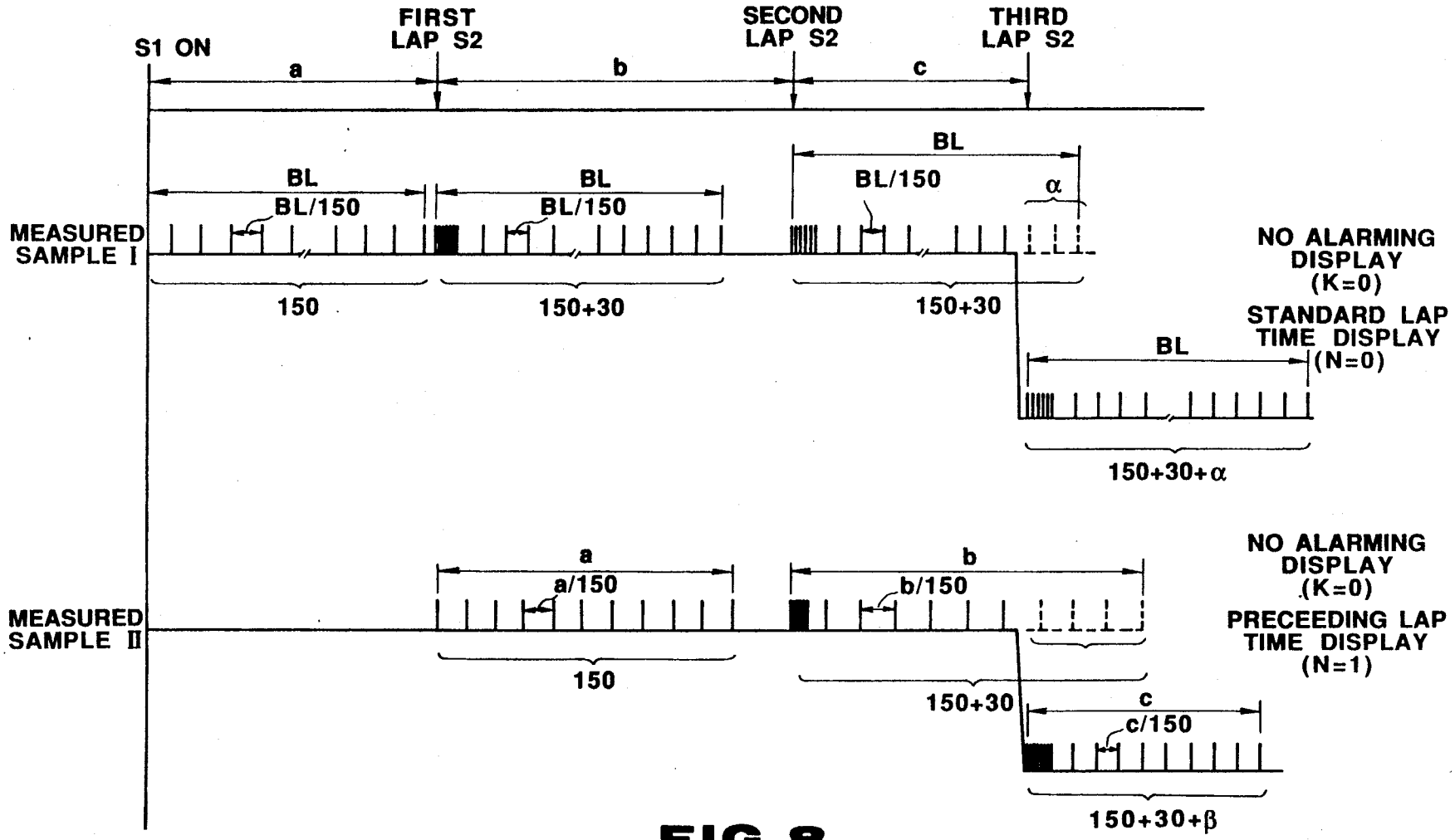
FIG. 8 is a schematic view showing a driving interval of a step motor in a stopwatch mode.

Then, the action of the stopwatch constituted as described above will be described by using measured samples of FIGS. 8 and 9.

When the value of the mode register M is "0", the same time as the present time stored in the register BT and displayed on the digital display portion 7 is displayed by the hour hand and the minute hand. If the time displayed by the hour hand and the minute hand does not coincide with the present time stored in the register BT immediately after the stopwatch mode is switched to the time piece mode or when the time is corrected, the hour hand and the minute hand are quickly moved by the step S4 of FIG. 3, i.e., by the detailed flow chart shown in FIG. 4, to make both coincident with each other.

Figure 10A:
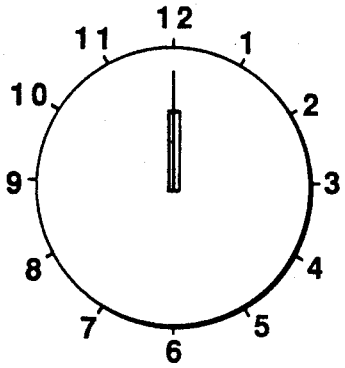
FIGS. 10A, 10B, 10C and 10D are a plan view schematically showing the movement of hands of the stopwatch of the present invention.
Figure 11A:
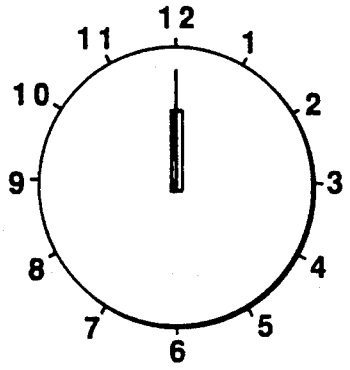
FIGS. 11A, 11B, 11C and 11D are a plan view schematically showing another example of the movement of hands of the stopwatch of the present invention.

In order to use the stopwatch, the key SM is operated. The value of the mode register M becomes "1" in the step S43 of FIG. 5 by this operation, and "0" is set respectively to the register ST, the registers ANP, BNP is the next step S44. Thus, the minute hand and the hour hand are moved to the position corresponding to the value "0" of the registers ANP, BNP, i.e., the position of 12 o'clock as shown in FIGS. 10A and 11A, in the step S7 of FIG. 3, i.e., by the process of FIG. 7. The value "0" of the register ST is displayed on the digital display portion 7.

Before the measurement of the stopwatch is started, it is selected which one of a preset time and a preceding lap time is used as a standard lap time displayed by the minute hand. And if the preceding lap time is not selected, a desired time is set as the standard lap time. Further, it is selected whether the alarm display in which the minute hand is quickly moved for a predetermined time is executed or not when the time being measuring at present very approaches to the standard lap time. And when the alarm display is executed, it is necessary to set an alarm display continuous time.

The case that the alarming display is not executed will be described firstly by referring to FIG. 8.

I. (Measured sample I): A present standard lap time is displayed and no alarm display is not executed.

In this case, before the measurement is started, "0" is respectively set to the register N and to the register K, and a desired time is set as the standard lap time to the register BL. That is, before the measurement is started, the key S2 is operated. By this operation, the value of the register J becomes "1" in a step S65. After this operation, switching between the standard lap time and the preceding lap time can be executed by the key S3, and the selection whether the alarming display is executed or not can be executed by the key S4. When the key S3 is operated in this state, "0" is set to the register N in the step S70. And, when the key S4 is operated in this state, "0" is set to the register K in the step S76. Further, by the operation of the key S2, "2" is set to the register J in the step S65, thereby setting the standard lap time setting mode. Whenever the key S3 or S4 is operated in this state, "+1" or "−1" is set to the register BL in the step S71 or step S77 to set the desired time as the standard lap time. Further the key S2 is operated twice to set "0" to the register J in the step S66.

Figure 10B:
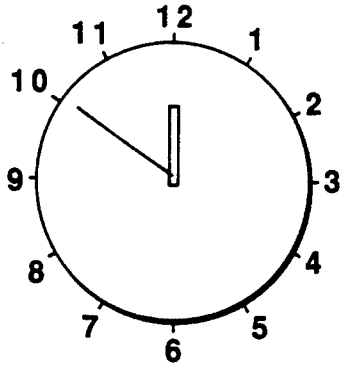

The key S1 is operated, for example, at the same time that a race starts. When the key S1 is operated, the value of the register FR becomes "1" in the step S48 of FIG. 5, the registers Y, LAP, I and FAZ are cleared in the next step S49, and in the step S81 it is judged that the present desired time is selected as the standard lap time (N=0), and "0" is set to the register FAS in the step S82. When the value of the register FR becomes "1", the time measurement is started by the registers ST and Y in the step S6 of FIG. 3, i.e. in the steps 101, 102 in FIG. 6. In the measured sample I, since the preset desired time is selected as the standard lap time, and "0" is set to the register N, the standard lap time of the register BL is stored in the register W in the step S106. And, 1/32 second is added to the register LPA in the step S109. Since "0" is set to the register K, in the step S111 it is judged whether the lapse time elapsed from the lap time measurement start and measured by the register Y is smaller than the standard lap time or not. If it is smaller, in the step S112 it is judged whether the time for moving the minute hand one step, i.e., 1/150 of the standard lap time, is elapsed or not. If it is elapsed, the period (W/150) of one step is subtracted from the time of the register LPA, and the value of the register ANP is set to "+1" in the step S114. Thus, when the step S7 of FIG. 3, i.e., the process of FIG. 7, is started, the minute hand is moved for one step. According to this, the processes of steps S6 and S7 of FIG. 3, i.e., the processes of FIGS. 6 and 7, are executed at every 1/32 second from the lap time measurement start, the minute hand is continuously moved in the period of 1/150 of the standard lap time as shown in FIG. 10B, and percentage of the lapse time to the standard lap time is displayed by the positional relationship between the minute hand and the hour marks on the dial plate.

Figure 10C:
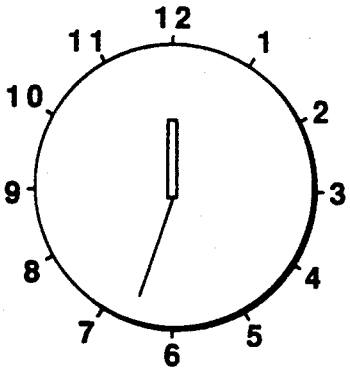

When the standard lap time is elapsed from the start and the minute hand is rotated 150 steps to arrive at the position of 10 o'clock, it is judged that the lapse time of the register Y from the start is not smaller than the standard lap time in the step S111 of FIG. 6, and then the process of the step S114 is not started. Accordingly, since the increment of the register ANP is not executed, the minute hand is stopped as shown in FIG. 10c.

Figure 9:
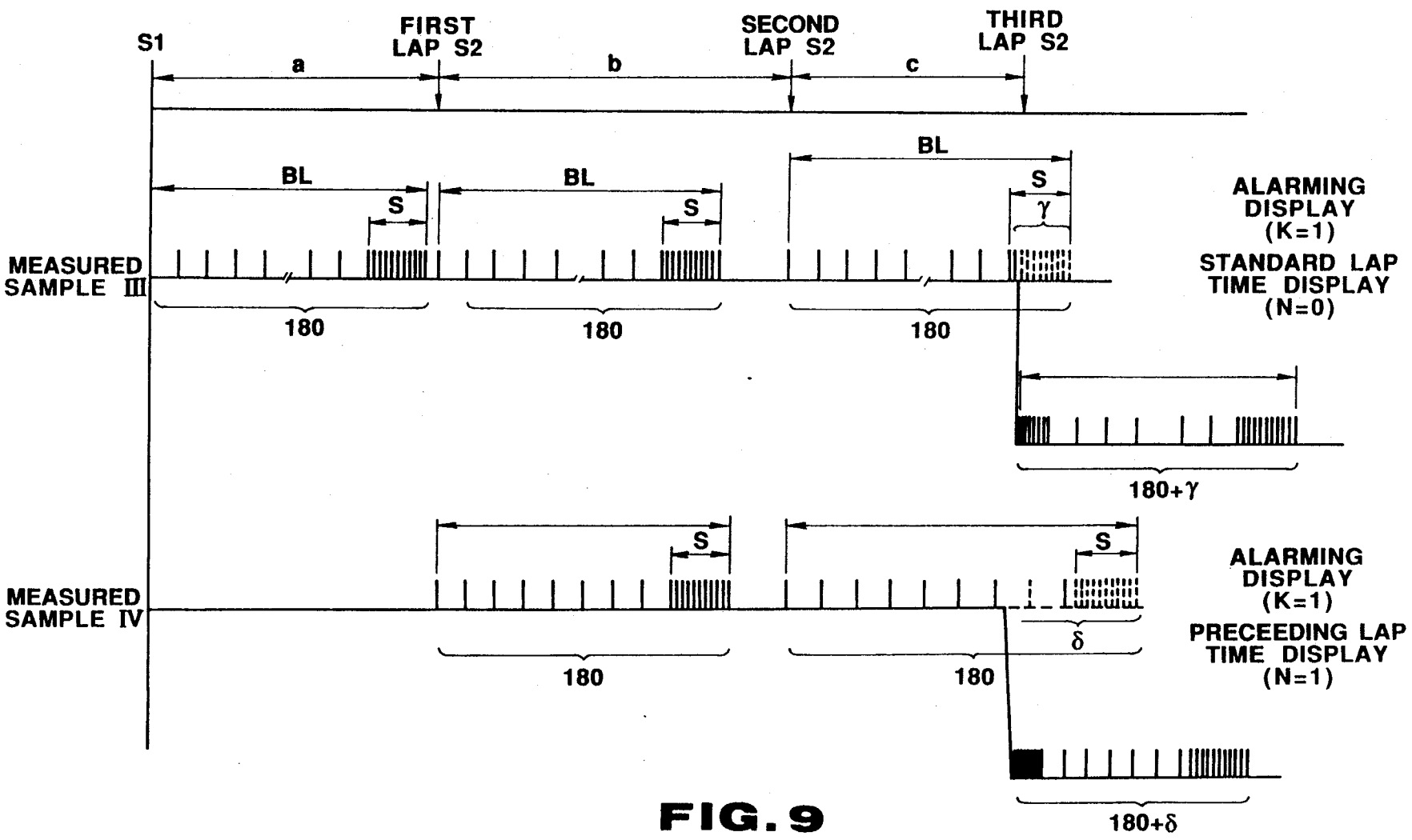
FIG. 9 is a schematic view showing another sample of the driving interval of the step motor in the stopwatch mode.
Figure 10D:
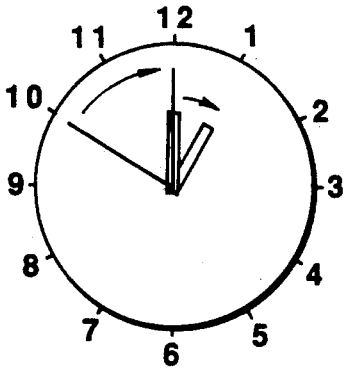

When the key S2 is operated to measure the first lap time after "a" time has elapsed from the start as in the measured sample I of FIG. 9, the operation of the key S2 is detected in the step S51 of FIG. 5, and "1" is set to the register I for storing the lap number in the step S53. The lapse time elapsed from the lap time measurement start and measured by the register Y is stored as the first lap time in the first lap time memory $MA_1$ in the step S54, and the register Y is cleared in the step S55. Since "0" is set to the register FAS, "1" is set to the register FAS, and the register LPA and the register ANP are cleared in the steps S59 and S60. In order to display the lap numbers by the hour hand, the product of 15×the lap numbers, i.e., "15" in this case, is set to the register BNP in a step S61. Thereafter, the minute hand is moved to the position of 12 o'clock as shown in FIG. 10D by the process of FIG. 7, and the hour hand is moved to the position of "15", i.e., the position of 1 o'clock. Subsequently, the minute hand is being driven stepwisely at the period of 1/150 of the standard lap time similarly to the above described case immediately after the start, and the percentage of the measured time for this lap to the standard lap time is displayed by the positional relationship between the minute hand and the hour marks on the dial plate.

If the measured time for the lap coincides with the standard lap time, the minute hand stops at the position of 10 o'clock. If the key S7 is operated to finish the second lap time measurement after "b" time has passed from the start of the second lap time measurement, the operation of the key S2 is detected in the step S51, "2" is set to the register I in the step S53, the measured time for this lap measured by the register Y is stored in the second lap time memory $MA_2$ in the step S54, and the product of 15×lap number, i.e., "30" in this case, is set to the register BNP in the step S61. Thus, the minute hand is moved to the position of 12 o'clock by the process of FIG. 7, and the hour hand is moved to the position of "30", i.e., the position of 2 o'clock. Thereafter, the minute hand is again stepwisely driven in the period of 1/150 of the standard lap time, and the percentage of the measured time for this lap to the standard lap time is displayed by the positional relationship the minute hand and the hour marks on the dial plate.

If the third lap time measurement is finished when the measured time for this lap does not elapse for the standard time, i.e., the minute hand dose not arrive at the position of 10 o'clock, and more specifically, when the minute hand arrives at a position which is "2" steps before the position of 10 o'clock, the operation of the key S2 is detected in the step S51, and "3" is set to the register I for storing the lap number in the step S53, the measured time for this time measured by the register Y is stored in the third lap time memory MA3 in the step S54, and the register Y is cleared. In order to display the lap number by the hour hand, the product of 15×lap number, i.e., "45", is set to the register BNP in the step S61. Subsequently, the minute hand is moved to the position of 12 o'clock by the process in FIG. 7, the hour hand is moved to the position of "45", i.e., the position of 3 o'clock. When the first and second lap times are measured, the minute hand stops at the position of 10 o'clock. But since the third lap time measurement is finished when the minute hand arrives at a position which is "α"steps before the position of 10 o'clock, the minute hand is moved is faster than II. (Measured sample II): A preset desired time is displayed as a standard lap time, and an alarm display is not executed.

In this case, at first "1" is set in the register N by the operation of the above-described key S3 in the step S70. Thus, when the key S1 is operated at the time of starting, it is judged that the value of the register N is "1" in the step S81, and "1" is set in the register FAS in the step S83. When "1" is set in the register FAS, it is judged that the value of the register FAS is not "0" in the step S103 in the state that the key S2 for measuring lap time has never operated in the process of FIG. 6, and the minute hand is not driven.

When the key S2 is operated to measure the first lap time after the "a" time elapses from the first lap time measurement start, it is detected in the step S51 of FIG. 5, "1" is set to the register I for storing the lap number in the step S53, the lapse time, elapsed from the first lap time measurement start and measured in the register Y, is stored in the first lap time memory $MA_1$ in the step S54, and the register Y is cleared in the step S55. It is judged that the register FAS is not "0" in the step S56, and "1" is set to the register FAS in the step S57. The production of 15×lap number, i.e., "15" in this case, is set in the register BNP in the step S61. Thus, the minute hand is moved to the position of 12 o'clock by the process in FIG. 7, and the hour hand is moved to the position "15", i.e., the position of 1 o'clock.

Then, the process of FIG. 6 is executed at each 1/32 second, it is judged that the value of the register FAS is "0" in the step S103, it is judged that the value of the register N is not "1" in the step S104, and it is judged that the lap number of the register I is not "0" in the step S107, and hence the routine of this process advances to the step S108. In the step S108, the first lap time stored in the first lap time memory $MA_1$ is set in the register W. Thereafter, the minute hand is stepwisely driven in the period of 1/150 of the first lap time "a" by the steps S109, S111, S112, S113 and S114, and the percentage of the measured time for this lap to the first lap time is displayed by the positional relationship between the minute hand and the hour marks on the dial plate. If the second lap time measurement is not finished after the same lapse time as the first lap time is elapsed from the start of the second lap time measurement and the minute hand is driven 150 steps to be moved to the position of 10 o'clock, it is judged that the measured time for this lap measured by the Y register is not smaller than the first lap time in the step S111 of FIG. 6, and hence the process of the step S114 is not started. Thus, since the increment of the value of the register ANP is not executed, the minute hand is stopped. When the key S2 is again operated to end the second lap measurement after the "b" time elapsed from the start of the second lap time measurement, the operation of the key S2 is detected in the step S51, "2" is set to the register I in the step S53, the measured time for this lap measured by the register Y is stored in the second lap time memory $MA_2$, and the product of 15×lap number, i.e., "30" is this case, is set in the register BNP in the step S61. Thus, the minute hand is moved to the position of 12 o'clock by the process of FIG. 7, the hour hand is moved to the position of "30", i.e., the position of 2 o'clock. Subsequently, the minute hand is again driven stepwisely in the period of 1/150 of the second lap time "b", and the percentage of the measured time for this lap to the second lap time is displayed by the positional relationship between the minute hand and the hour marks on the dial plate.

If the third lap measurement is finished when the measured time for this lap does not elapse for the second lop time, i.e., the minute hand does not arrive at the position of 10 o'clock, and more specifically, when the minute hand arrives at a position which "β"steps before the position of 10 o'clock, the operation of the key S2 is detected in the step S51, "3" is set to the register I for storing the lap number in the step S53, the measured time for this lap measured by the register Y is stored in the third lap time memory $MA_3$ in the step S54, and the register Y is cleared. In order to display the lap number by the hour hand, the product of 15×lap number, i.e., "45" is this case, is set in the register BNP in the step S61. Thereafter, the minute hand is moved to the position of 12 o'clock by the process of FIG. 7, the hour hand is moved to the position of "45", i.e., the position of 3 o'clock. When the first and second lap times are measured, the minute hand stops at the position of 10 o'clock. But, since the third lap measurement is finished when the minute hand arrives at a position which is "β" steps before the position of 10 o'clock, the minute hand is moved faster than in the case of the second lap time measurement by "β" steps. When the minute hand is quickly moved by the flow of FIG. 7 and arrives at the position of 12 o'clock, i.e., the value of the register ANP is set to "0", the value of the register FAZ is detected to be "0" in the step S25, and hence the value of the register FAZ is set to "0" in the step S27. Thus, the minute hand does not stop at the position of 12 o'clock, and is started to be moved in the period of 1/150 of the third lap time.

Then, the action of alarm display for readily informing a state that the time being measuring at present approaches to the vicinity of the standard lap time or the preceding lap time of FIG. 9 will be described.

The alarm display will be first described. In the alarm display, the minute hand moves at a high speed when the time being measuring at present falls in a preset time range set by the user at the end portion of the standard lap time or the preceding lap time. For example, in case that the time being measuring at the present time is displayed by the position of the minute hand on the dial plate, if 60 seconds as the standard lap time is set to the register BL and 10 seconds as the alarming display time is set to the register S, the minute hand is driven in the period of 60/150=0.4 during the initial 50 seconds. When 50 seconds are elapsed, the minute hand is positioned at the position of 8.3 o'clock, i.e., the position of "125". Therefore, the minute hand must be driven 55 steps during 10 seconds of the alarm display continuous time. As a result, the minute hand is driven in the period of 10/55=0.182 during the alarm display continuous time.

In other words, the minute hand is driven in the period of the standard lap time/150 (the number of steps from the start of this lap time measuring to the position of 10 o'clock) similarly to the case of no alarm display until the lapse time elapsed from the start of this lap time measuring coincides with the time which is before the standard lap time (the preset desired time or the preceding lap time) by the alarm display time.

And the minute hand is driven in the period of [standard lap time×alarm display continuous time (register S)]/[30 (the number of steps from 10 to 12 o'clock)×standard lap time+150×alarm display continuous time]

III. (Measured sample III): A preset desired time is displayed as a standard lap time and an alarm display is executed.

In this case, before the measurement is started, it is necessary to set "0" to the register N, "1" to the register K, the standard lap time to the register BL, and the alarm display continuous time to the register S. More specifically, after the key S2 is operated to set "1" to the register J, the key S3 is operated to set "0" to the register N in the step S70, and the key S4 is operated to set "1" to the register K in the step S76. Then, the key S2 is again operated, "2" is set to the register J and the standard lap time is set. The key S2 is further operated to set "3" to the register J, the desired alarm display continuous time of the register S is set by adding "+1" or "−1" thereto at each operation of the key S3 or the key S4.

Figure 11B:
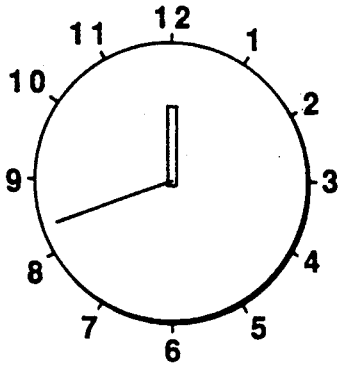
Figure 11C:
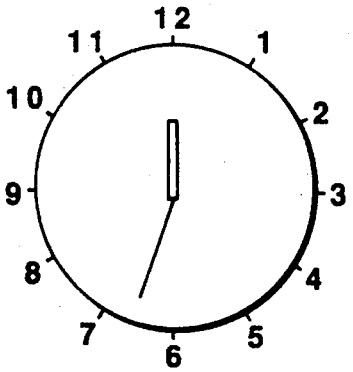
Figure 11D:
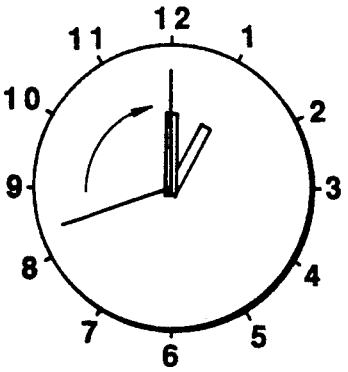

When the start key S1 is operated to start the lap time measurement, the value of the register FR becomes "1" in the step S48 of FIG. 5, the registers Y, LPA, I and FAZ are cleared in the next step S49, and "0" is set to the register FAS in the step S82. When the value of the register FR becomes "1", the time measurements by the register ST and the register Y start in the step S6 of FIG. 3, i.e., the steps S101 and S102 of FIG. 6. Since "0" is set to the register N and the standard lap time is stored, the standard lap time is stored in the register W in the step S106, and 1/32 second is added to the register LPA in the step S109. Since "1" is set to the register K, the routine advances to the step S115, and it is judged whether the time obtained by subtracting the alarm display continuous time of the register S from the standard lap time of the register W is smaller than the lapse time elapsed from the lap time measurement start and measured by the register Y or not. Since it is judged that the remainder is smaller than the lapse time in the step S115 immediately after the lap time measurement start, the routine advances to the step S116 to judge whether the time for moving the minute hand one step is elapsed or not. If the time is elapsed, the period of one step (W/150) is subtracted from the time of the register LPA, and the value of the register ANP is added by "+1" in the step S114. Thus, the minute hand is driven one step in the step S7 of FIG. 3, i.e., by the process of FIG. 7. Thus, the processes of the steps S6 and S7 of FIG. 3, i.e., the processes of FIGS. 6 and 7, are executed at each 1/32 second from the lap time measurement start, the minute hand is driven in the period of 1/150 of the standard lap time as shown in FIG. 11B, and the percentage of the lapse time elapsed from the lap time measurement start to the standard lap time is displayed by the positional relationship between the minute hand and the hour narks on the dial plate. When the lapse time coincides with the alarm display starting time (which is shorter than the standard lap time of the register W by the alarm display continuous time of the register S) as shown in FIG. 11C, it is detected in the step S115, and it is judged whether the value of the register LPA is larger than the alarm display period for moving the minute hand at the number of steps from the present position to the position of 12 o'clock in the alarm display continuous time or not. If it is larger, the alarm display period is subtracted from the register LPA, and the value of the register ANP is added by "+1" in the step S114. Thus, the minute hand is driven one step in the step S7 of FIG. 3, i.e. by the process of FIG. 7. Thereafter, the minute hand is driven in the alarm display period by the flows of FIGS. 6 and 7, as shown in FIG. 11D.

If the first lap time measurement is not finished after the lapse time elapsed from the lap time measurement start coincides with the standard lap time, the process of FIG. 6 is repeated to make the value of the register ANP become "180". When it is detected in the step S115, "0" is set to the register ANP in the step S116. In the process of FIG. 7, since the motor "A" is driven stepwisely and "+1" is added to the register ATP at every time the motor "A" rotates one step until the value of the register ANP coincides with that of the register ATP, "0" is set to the register ATP in the step S24 of the process of FIG. 7 when "0" is set to the register ANP in the process of FIG. 6. And, it is judged that the value of the register FAZ is "1" in the step S25, and "1" is set to the register FAS in the step S26. Therefore, it is judged that the value of the register FAS is not "0" in the step S103 even if the process of FIG. 6 is executed at each 1/32 second. And, since the increment of the register ANP is not executed, the minute hand stops at the position of 12 o'clock.

When the key S2 is operated to finished the lap time measurement after "a" time elopses, the operation of the key S2 is detected in the step S51 of the process of FIG. 5, "1" is set to the register I in the step S53, the lapse time elapsed from the first lap time measurement start and measured by the register Y is stored in the first lap time memory $MA_1$ in the step S55, and the register Y is cleared in the step S55. Since "1" is set to the register FAS, "0" is set to the register FAS in the step S57, and the product of 15×lap number, i.e., "15" in this case, is set to the register BNP in the step S61. Thereafter, the minute hand is moved to the position of 12 o'clock by the process of FIG. 7, and the hour hand is moved to the position of "15", i.e., the position of 1 o'clock. Subsequently, the minute hand again starts, its movement in the period of 1/150 of the standard lap time, and the percentage of the lapse time elapsed from the lap time measurement start to the standard lap time is displayed by the positional relationship between the minute hand and the hour marks on the dial plate. When the lapse time arrives at the alarm display starting time, the minute hand is driven at the alarm display period. If the second lap time measurement is finished after the lapse time from the start of the second lap measurement coincides with the standard lap time, the minute hand stops at the position of 12 o'clock. When the key S2 is operated to finish the second lap time measurement after "b" time is elapsed from the start of the second lap measurement, the operation of the key S2 is detected in the step S51, "2" is set to the register I in the step S53, the measured time for this lap measured by the register Y is stored in the second lap time memory MA2 in the step S54, and the register Y is cleared in the step S55. Then, the product of 15×lap number, i.e., "30" in this case, is set to the register BNP. Thereafter, the minute hand is moved to the position of 12 o'clock by the process of FIG. 7, and the hour hand is moved to the position of "30", i.e., the position of 2 o'clock. Subsequently, the minute hand again starts its movement in the period of 1/150 of the standard lap time, the percentage of the measured time for this lap to the standard lap time is displayed by the pointional relationship between the minute hand and the hour marks on the dial plate. When the lapse time arrives at the alarm display starting time, the minute hand is driven in the alarm display period.

When the third lap measurement is finished before the measured time for this lap coincides to the standard lap time, i.e., before the minute hand arrives at a portion which is before the position of 12 o'clock by "γ" steps, the operation of the key S2 is detected in the step S51, "3" is set to the register I in the step S53, the lapse time elapsed from the end of the second lap time measurement and measured by the register Y is stored in the third lap time memory $MA_3$ in the step S54, and the register Y is cleared in the step S55. In this case, since the minute hand does not arrive at the position of 12 o'clock, the value of the register FAS remains "0", and hence "1" is set to the register FAZ in the step S58. Then, the product of 15×lap number, i.e., "45" in this case, is set to the register BNP. Thereafter, the minute hand is moved to the position of 12 o'clock by the process of FIG. 7, and the hour hand is moved to the position of "45", i.e., the position of 3 o'clock. When the first and second lap times are measured, the minute hand stop at the position of 12 o'clock. But, since the third lap time measurement is finished when the minute hand arrives at a position which is "γ" steps before the position of 12 o'clock, the minute hand is moved faster than in the case of the second lap time measurement by "γ"steps. When the minute hand is quickly moved by the flow of FIG. 7 and arrives at the position of 12 o'clock, i.e., the value of the register ANP becomes "0", the value of the register FAZ is detected to be "0" in the step S25, and the value of the register FAZ is set to "0" in the step S27. Thus, the minute hand does not stops at the position of 12 o'clock, and again starts its rotation in the period of 1/150 of the standard lap time, and moves in the alarm display period when the elopes time from the lap time measurement start coincides with the alarm display starting time.

IV. (Measured sample IV): A preceding lap time is displayed as a standard lap time and an alarm display is executed.

In this case, before the lap time measurement is started, "1" is set to the register N, "1" is set to the register K and the alarm display continuous time is set to the register S. Since "1" is set to the register FAS in the step S83 of FIG. 5 when the key S1 is operated at the time of starting, it is judged that the value of the register FAS is not "0" in the step S6 of FIG. 3, i.e., in the step S106 of the process of FIG. 6, in the state that the key S2 for measuring lap time has never operated, and the minute hand is not driven.

When the key S2 for measuring the lap time is operated and the first lap measurement starts, the operation of the key S2 is detected in the step S51, "1" is set to the register I in the step S53, the lapse time elapsed from the start of this lap time measurement and measured by the register Y is stored in the first lap time memory $MA_1$ in the step S54, and the register Y is cleared in the step S55. Since the value of the register FAS is set to "0", "1" is set to the register FAZ in the step S58, and the product of 15×lap number, i.e., "15" in this case, is set to the register BNP in the step S61. Thus, the hour hand is moved to the position of "15", i.e., the position of 1 o'clock, by the process of FIG. 7. Thereafter, the process of FIG. 6 is executed at each 1/32 second. Since it is judged that the value of the register FAS is "0" in the step S103, the value of the register N is not "1" in the step S104 and the lap number of the register I is not "0" in the step S107, the routine advances to the step S108. Since the first lap time is set to the register W in the step S108, the minute hand is then stepwisely driven in the period of 1/150 of the first lap time, and the percentage of the lapse time from the start of the lap time measurement for this lap to the first lap time is displayed by the positional relationship between the minute hand and the hour marks on the dial plate. When the lapse time coincides with the alarm display start time (which is smaller than the preceding lap time by the alarm display continuous time), it is detected in the step S116, it is judged whether the value of the register LPA is larger than the alarm display period for moving the minute hand at the number of steps from the present position to the position of 12 o'clock in the alarm display continuous time or not in the step S118. If it is larger, the alarm display period is subtracted from the value of the register LPA, and "+1" is added to the value of the register ANP in the step S114. Thus, the minute hand is driven one step in the step S7 of FIG. 3, i.e., by the process of FIG. 7. Thus, after the alarm display start time, the minute hand is driven in the alarm display period until the minute hand is moved to the position of 12 o'clock.

If the second lap time measurement is not finished after the lapse time elapsed from the start of the second lap time measurement coincides with the first lap time, the process of FIG. 6 is repeated the make the value of the register ANP become "180", and the value of the register ANP is set to "0". Thus, it is detected that the value of the register ATP becomes "180" in the step S23 of FIG. 7, and the value of the register ATP is set to "0" in the step S24. The value of the register FAZ is judged to be "1" in the step S25, and the value of the register FAS is set to "1" in the step S26.

Therefore, it is judged that the value of he register FAS is not "0" in the step S103 even if the process of FIG. 6 starts at each 1/32 second, the increment of the register ANP is not executed, and hence the minute hand stops at the position of 12 o'clock.

When the key S2 for measuring the lap time is operated after "b" time elapses from the start of the lap time measurement for this lap and the second lap measurement is finished, it is detected in the step S51, the value of the register I is set to "2" in the step S53, and the lapse time elapsed from the start of the second lap time measurement and measured by the register Y is stored in the second lap time memory $MA_2$ in the step S54. Since "1" is set in the register FAS, the value of the register FAS is set to "0", and the product of 15×lap number, i.e., "30" in this case, is set to the register BNP. Thereafter, the hour hand is moved to the position of "30", i.e., the position of 2 o'clock, by the process of FIG. 7.

When the minute hand is quickly moved by the flow in FIG. 7 and arrives at the position of 12 o'clock, i.e., the value of the register ANP becomes "0", the value of the register FAZ is detected to be "0" in the step S25, and hence the value of the register FAZ is set to "0" in the step S27.

Thereafter, the minute hand again starts its movement in the first period of 1/150 of the second lap time, and the percentage of the lapse time elapsed from the start of the lap time measurement for this lap to the second lap time is displayed by the positional relationship between the minute hand and the hour marks on the dial plate. When the lapse time coincides with the alarm display start time, the minute hand is moved in the second period, but when the third lap time measurement is finished before the measured time for this lap coincides with the alarm display start time, i.e., the minute hand arrives at the position of 10 o'clock, more specifically when the minute hand arrives at a position which is "δ"steps before the position of 12 o'clock, the operation of the key S2 is detected in the step S51, the value of the register I for storing the lap number is set to "3", and the lapse time elapsed from the lap time measurement start for this lap and measured by the register Y is stored in the third lap time memory $MA_3$. Since the value of the register FAS is set to "0", the value of the register FAZ is set to "1" in the step S58, and the product of 15×lap number, i.e., "45" in this case, is set to the register BNP in the step S61. Thereafter, the minute hand is moved to the position of 12 o'clock by the process of FIG. 7, and the hour hand is moved to the position of "45", i.e., the position of 3 o'clock. Since the third lap time measurement is finished when the minute hand arrives at a position which is "δ" steps before the position of 12 o'clock, the minute hand is moved faster than in the case of the second lap time measurement by "δ" steps. Since the value of the register FAZ is detected to be "0" in the step S25 when the minute hand is quickly moved by the flow of FIG. 7 and arrives at the position of 12 o'clock, i.e., when the value of the register ANP becomes "0", the value of the register FAZ is set to "0" in the step S27. Thus, the minute hand does not stop at the position of 12 o'clock, and starts its rotation in the first period of 1/150 of the third lap time, and when the measured time for this lap time coincides with the alarm display start time, the minute hand is driven in the alarm display period.

In the embodiments described above, the stopwatch is associated in the electronic time piece having the minute hand and the hour hand has been described. However, the present invention is not limited to the particular embodiments described above. For example, the stopwatch may be associated with an electronic time piece having a second hand, a minute hand and an hour hand, and the percentage display of the measured lap time may be executed by any of the second hand, the minute hand and the hour hand. Further, it is not executed by any of the second hand, the minute hand and the hour hand, but an exclusive hand for the percentage display of the measured lap time may be provided.

In the embodiments described above, the measured time and the lap time measured by the stopwatch are displayed by the digital display portion 7. However, the present invention is not limited to the particular embodiments described above. For example, the measured time and the lap time measured by the stopwatch may be displayed by a hand.

Additional advantages and modifications will readily occur to those skilled in the art. Therefore, the invention in its broader aspects is not limited to the specific details, representative devices, shown and described herein. Accordingly, various modifications may be made without departing from the spirit or scope of the general inventive concept as defined by the appended claims and their equivalents.

What is claimed is:

1. A stopwatch comprising:

time measuring means which starts time measurement on a basis of a start command;

a lap switch to be operated during a time measurement by the time measuring means;

lap time means for obtaining time information from the preceding operation of the lap switch when the lap switch is operated; and hand means rotatably driven to a position of "0" o'clock when said lap switch is operated, and to a position of "10" o'clock when the same time as the time information obtained by said lap time means is elapsed.

2. The stopwatch according to claim 1, further comprising:

measured time display means for displaying time information measured by said time measuring means.

3. The stopwatch according to claim 2, wherein said measured time display means includes optical display means for optically displaying said time information.

4. The stopwatch according to claim 2, wherein said measured time display means includes a step motor rotatably driven upon laps of time, and stopwatch hand means rotated by said step motor.

5. The stopwatch according to claim 1, wherein said lap time means includes lap time measuring means which starts time measurement after being cleared by the operation of said lap switch.

6. The stopwatch according to claim 1, wherein said hand means includes a step motor, and a hand rotatably driven from a position of said 0 o'clock to a position of said 10 o'clock by the rotation of said step motor.

7. The stopwatch according to claim 1, wherein said hand means includes a dial plate on which at least hour marks of 0 o'clock to 10 o'clock are provided, a step motor, and a hand rotatably driven from a position of said 0 o'clock to a position of said 10 o'clock provided on said dial plate by the rotation of said step motor.

8. The stopwatch according to claim 1, wherein said hand means includes hand step moving means for stepwisely moving a hand from a position of said 0 o'clock to a position of said 10 o'clock at equal time interval.

9. The stopwatch according to claim 1, wherein said hand means includes a hand, and moving means for moving said hand to a position of 0 o'clock when said lap switch is operated.

10. The stopwatch according to claim 1, wherein said hand means includes a hand, and stop means for stopping the rotary movement of said hand after said hand is rotatably moved to a position of 10 o'clock.

11. A stopwatch comprising:

a step motor rotatably driven at each unit time;

a dial plate on which hour numerals of at least 0 to 11 are provided;

hand means rotatably driven on said dial plate by the rotary movement of said step motor and displaying a present time;

moving means for moving said hand means to a position of 0 o'clock;

time measuring means which starts time measurement on a basis of a start command;

a lap switch to be operated during a time measurement by the time measuring means;

lap time means for obtaining time information from the preceding operation of the lap switch when the lap switch is operated; and hand control means for rotatably driving said hand means, moved to a position of 0 o'clock by said moving means when said lap switch is operated, to a position of 10 o'clock when the same time as time information obtained by said lap time means is elapsed.

12. The stopwatch according to claim 11, further comprising:

measured time display means for displaying time information measured by said time measuring means.

13. The stopwatch according to claim 12, wherein said measured time display mean includes optical display means for optically displaying said time information.

14. The stopwatch according to claim 11, wherein said lap time means includes lap time measuring means which starts time measurement after being cleared by the operation of said lap switch.

15. The stopwatch according to claim 11, wherein said hand means includes at least a minute hand for displaying a minute unit, and an hour hand for displaying an hour unit.

16. The stopwatch according to claim 11, wherein said hand control means includes hand step moving means for stepwisely moving said hand means from a position of said 0 o'clock to a position of said 10 o'clock at equal interval.

17. The stopwatch according to claim 11, wherein said hand means includes a hand, and said hand control means includes moving means for moving said hand to a position of 0 o'clock when said lap switch is operated.

18. The stopwatch according to claim 11, wherein said hand means includes a hand, and said hand control means includes stop means for stopping the rotary movement of said hand after said hand is rotatably moved to a position of 10 o'clock.

* * * * *